US011421608B2

(12) United States Patent
Zhang et al.

(10) Patent No.: US 11,421,608 B2
(45) Date of Patent: Aug. 23, 2022

(54) STAGGERED EXHAUST VALVE TIMING FOR EMISSION CONTROL

(71) Applicant: Ford Global Technologies, LLC, Dearborn, MI (US)

(72) Inventors: Xiaogang Zhang, Novi, MI (US); Steven Wooldridge, Manchester, MI (US); Brad VanDerWege, Plymouth, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 17/146,167

(22) Filed: Jan. 11, 2021

(65) Prior Publication Data

US 2022/0220907 A1 Jul. 14, 2022

(51) Int. Cl.

| | |
|---|---|
| ***F02D 13/02*** | (2006.01) |
| ***F02D 41/06*** | (2006.01) |
| ***F02D 41/00*** | (2006.01) |

(52) U.S. Cl.

CPC ..... *F02D 13/0246* (2013.01); *F02D 41/009* (2013.01); *F02D 41/064* (2013.01)

(58) Field of Classification Search

CPC .. F02D 13/0246; F02D 41/009; F02D 41/064; F02D 13/0257; F02F 1/4214; F01L 1/26

See application file for complete search history.

(56) References Cited

U.S. PATENT DOCUMENTS

| | | | | |
|---|---|---|---|---|
| 6,883,319 | B2 | 4/2005 | Ekenberg | |
| 8,701,409 | B2 | 4/2014 | Pursifull et al. | |
| 9,518,506 | B2 | 12/2016 | Leone et al. | |
| 10,161,334 | B2 | 12/2018 | Ulrey | |
| 10,655,547 | B2 | 5/2020 | Kimura et al. | |
| 2009/0133649 | A1* | 5/2009 | Nowatari | F02D 13/0257 123/90.17 |
| 2013/0098000 | A1* | 4/2013 | Ruhland | F02D 13/0246 60/273 |
| 2013/0269315 | A1* | 10/2013 | Ervin | F02M 26/42 60/273 |
| 2018/0170353 | A1* | 6/2018 | Ulrey | F01N 13/00 |
| 2018/0171913 | A1* | 6/2018 | Ulrey | F02D 41/1454 |
| 2018/0245497 | A1* | 8/2018 | Matsumoto | F01N 5/04 |
| 2020/0284217 | A1* | 9/2020 | Hakeem | F02M 26/22 |
| 2020/0300205 | A1* | 9/2020 | Pursifull | F02D 29/02 |

* cited by examiner

*Primary Examiner* — Sizo B Vilakazi

(74) *Attorney, Agent, or Firm* — Vincent Mastrogiacomo; McCoy Russell LLP

(57) ABSTRACT

Methods and systems are provided for reducing hydrocarbon emissions from an engine. In one example, a method may include adjusting timing profiles of a first and a second exhaust valve to selectively allow pneumatic communication between a cylinder and exhaust ports of an exhaust manifold during an engine cold start.

19 Claims, 12 Drawing Sheets

STAGGERED EXHAUST VALVE TIMING FOR EMISSION CONTROL

FIELD

The present description relates generally to methods and systems for adjusting exhaust valve timing to reduce exhaust emission.

BACKGROUND/SUMMARY

Exhaust emissions such as hydrocarbons (HCs) may be purged from engine cylinders during an exhaust stroke. The HCs may leave the cylinders through exhaust valves which are opened during the exhaust stroke to allow exhaust gases to flow out of the cylinders.

Engines may have multiple exhaust valves per cylinder. The multiple exhaust valves may improve the flow rate of gases from the cylinder by increasing the valve area, thereby increasing the engine efficiency. In addition, a multiple valve configuration may allow exhaust redirection for a turbocharger or numerous other applications. In engine systems with a split exhaust system, staggered exhaust valve timings may be used, such as in U.S. Pat. No. 8,701,409. However, the inventors herein have recognized that not only are such split exhaust systems difficult in terms of manufacturing complexity, they also do not enable exhaust from the two exhaust valves to assist each other in port oxidation.

Port oxidation is a reaction facilitated in exhaust ports of an exhaust manifold. The reaction includes oxidation of unburned HCs via mixing of the HCs with oxygen at high temperatures within the exhaust ports. Unburned HCs may accumulate in the exhaust manifold after an exhaust stroke of a combustion cycle due to variable combustion conditions, such as uneven combustion within the cylinder, non-stoichiometric combustion, condensation fuel on surfaces of the cylinder piston, etc. During the exhaust stroke, the unburned HCs may evaporate and be pushed into the exhaust manifold. The stored HCs may be mixed with combustion gases at a subsequent cylinder cycle but the mixing may be weak and oxidation only a portion of the HCs before the HCs are release to the atmosphere.

In contrast, other engines with multiple exhaust valves and exhaust ports per cylinder coordinate the opening and closing timings of the exhaust valves. Again, the inventors herein have recognized that while such operation is advantageous for various reasons, coordinated valve timings may not lead to enhanced port oxidation for some engine designs. For example, in the exhaust gas blowdown operation, hot exhaust gas may push HC residuals inside both exhaust ports and exhaust runners into the downstream exhaust. During some instances, such as cold engine starts, fuel-rich combustion and low engine temperature may lead to HC accumulation at the ports and runners. For example, exhaust flow right before exhaust valve closing can cause increased amounts of HC from evaporation of wetted piston top surfaces. The evaporated HC may be pushed slowly into the exhaust ports and runners and may remain in the exhaust ports and runners with limited HC oxidation due to lower exhaust gas temperature and lack of sufficient oxygen. The limited HC oxidation may increase a burden on exhaust aftertreatment devices, demanding additional aftertreatment actions. Thus, a method for adjusting the exhaust flow out of the cylinders to increase port oxidation is desirable.

In one example, the issues described above may be addressed by a method for operating an engine, comprising: adjusting timing of a first exhaust valve of a cylinder to open at a first crankshaft angle, the first exhaust valve selectively allowing pneumatic communication between the cylinder and a first exhaust port, the first exhaust port merging with a second exhaust port of the cylinder before merging with other exhaust passages of the engine; and adjusting timing of a second exhaust valve of the cylinder to open at a second crankshaft angle retarded from the first crankshaft angle, the second exhaust valve selectively allowing pneumatic communication between the cylinder and the second exhaust port. In this way, HC emissions may be reduced during cold starts.

As an example, flow mixing inside exhaust ports and an exhaust runner may be enhanced by staggering the timings of the first and second exhaust valves. Opening the first valve at the first crankshaft angle may promote merging of hot combusted gas with cold, residual HCs in at least one of the exhaust ports, thereby oxidizing at least a portion of the HCs. The delayed opening of the second valve allows additional combusted gas to flow into the exhaust port, increasing turbulent mixing and driving further oxidation of the HCs. In this way, exposure of residual HCs in the exhaust port to high temperature and oxygen-rich conditions is increased prior to atmospheric release.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
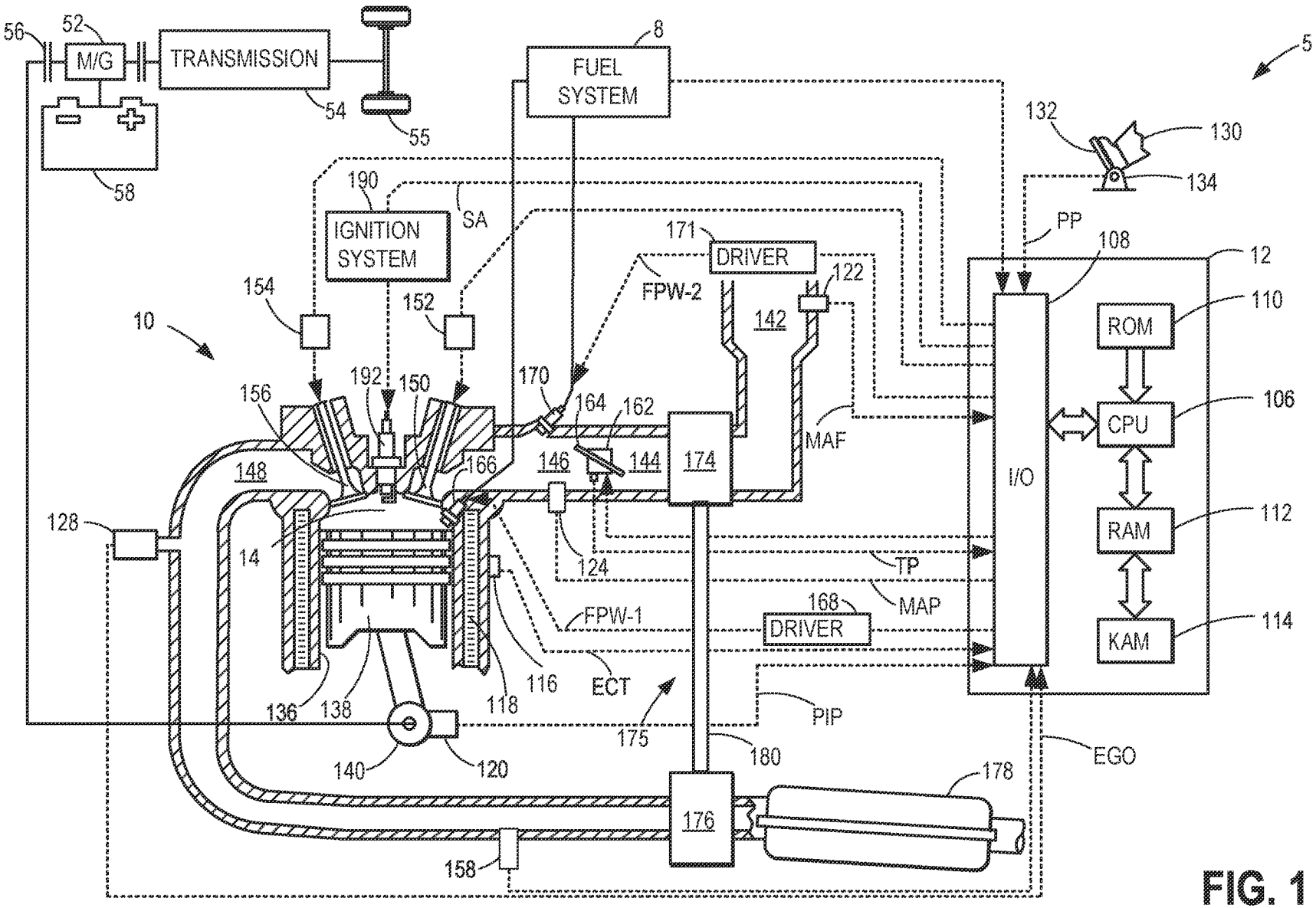
FIG. 1 shows a schematic diagram of an example engine system, depicting a single cylinder.
Figure 2:
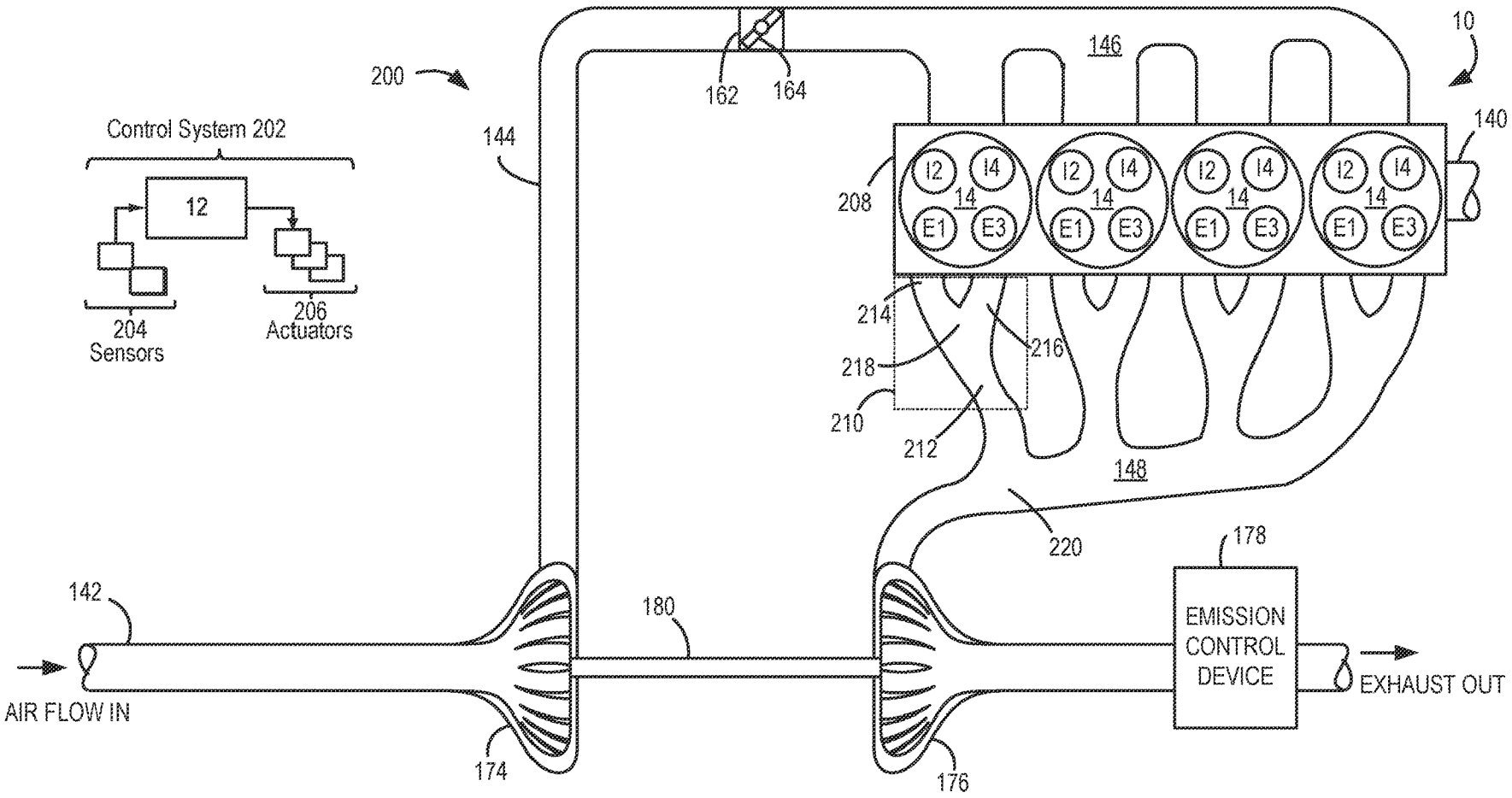
FIG. 2 shows the engine system of FIG. 1 with multiple cylinders coupled to a common exhaust manifold.
Figure 3:
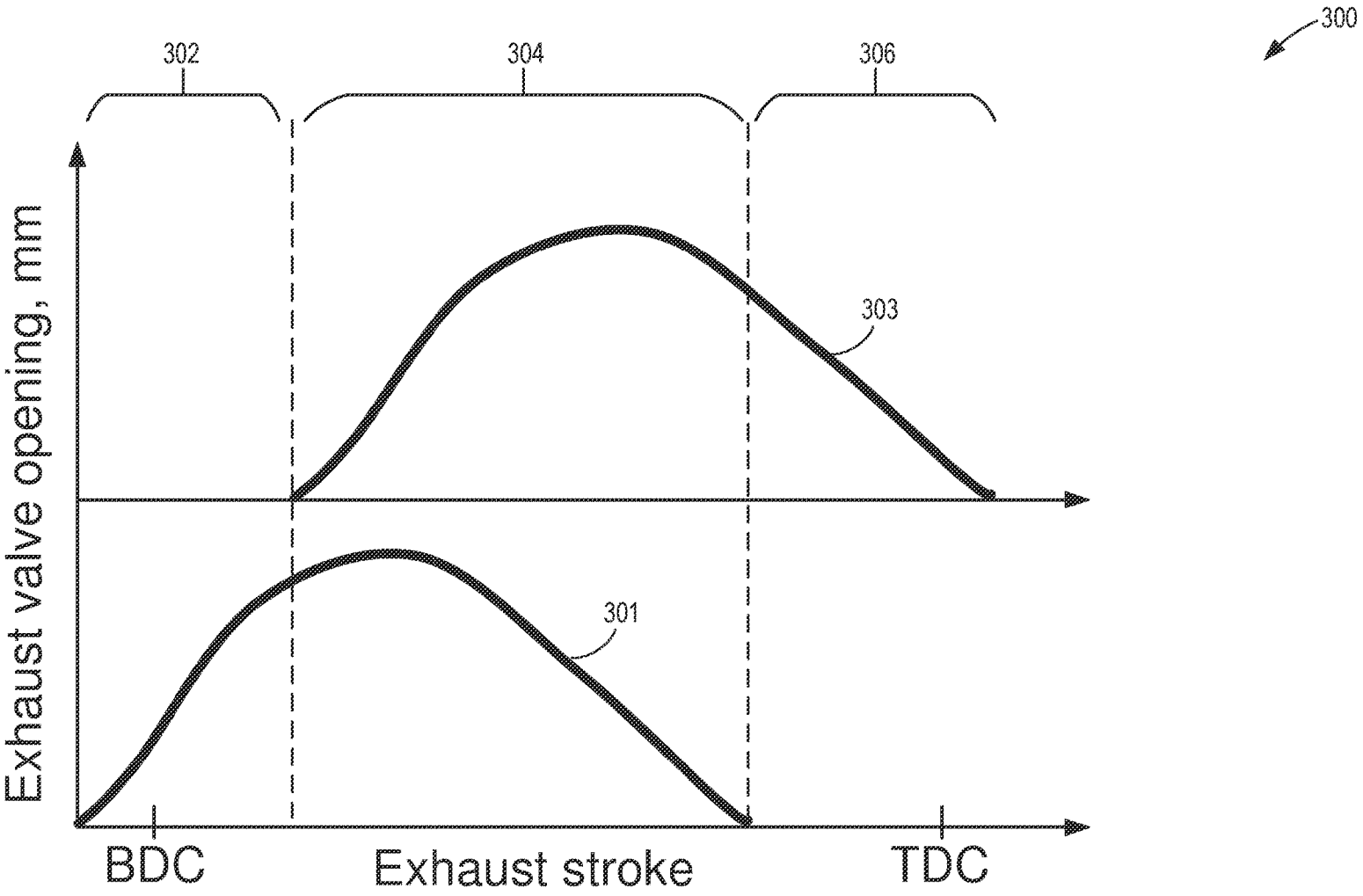
FIG. 3 shows a first graph depicting a first set of staggered exhaust valve timing profiles.
Figure 4B:
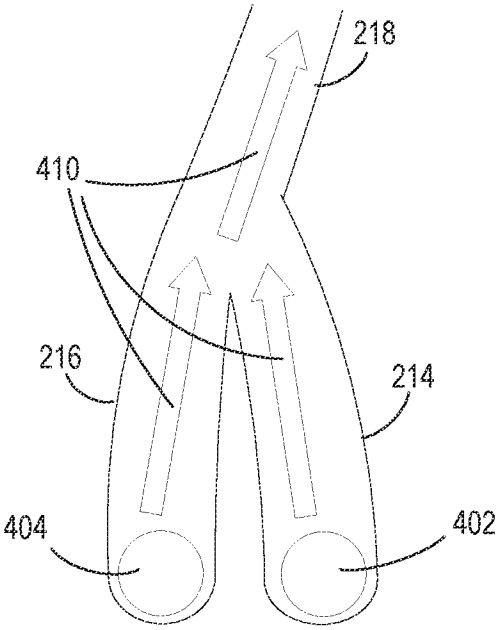
FIG. 4B shows exhaust flow through the exhaust ports corresponding to a second step of the first graph of FIG. 3.
Figure 4A:
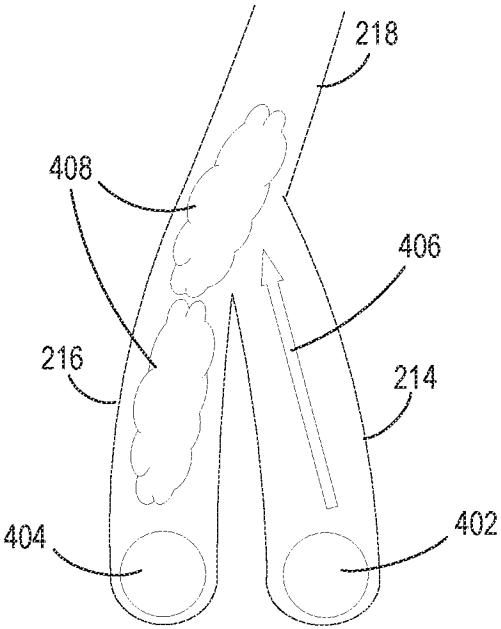
FIG. 4A shows exhaust flow through exhaust ports of a section of an exhaust manifold corresponding to a first step of the first graph of FIG. 3.
Figure 4C:
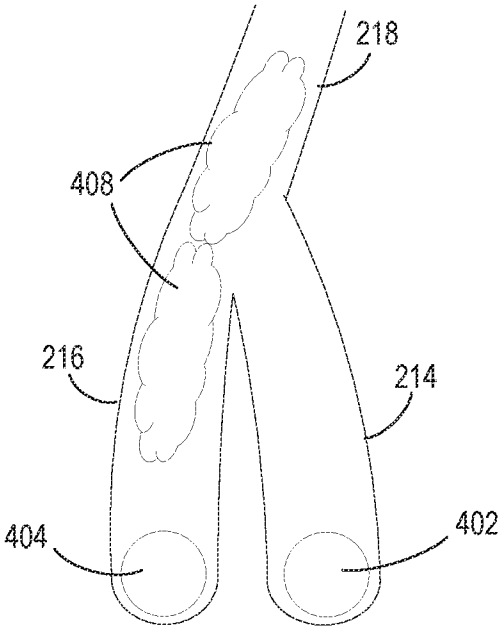
FIG. 4C shows exhaust flow through the exhaust ports corresponding to a third step of the first graph of FIG. 3.
Figure 5:
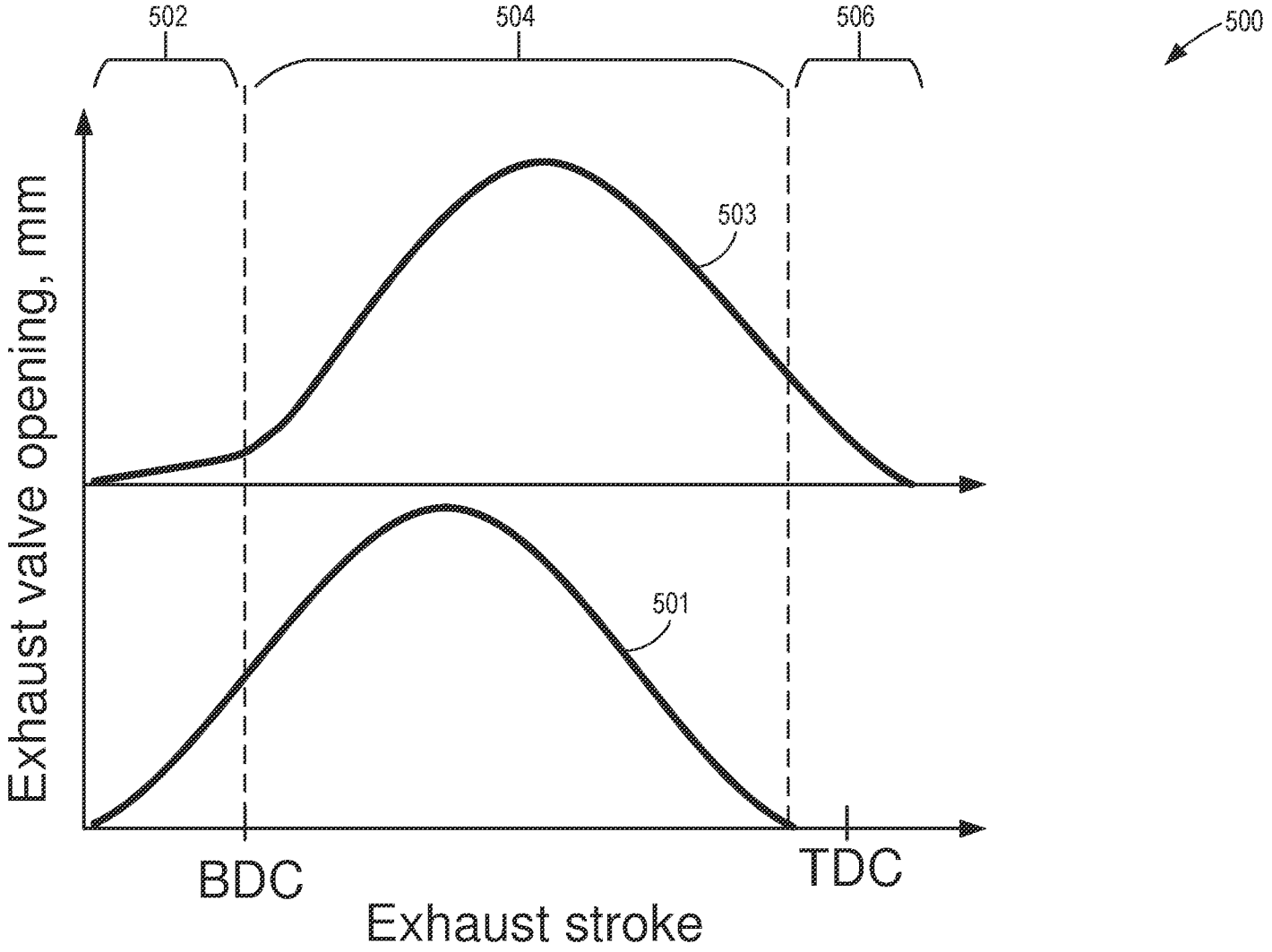
FIG. 5 shows a second graph depicting a second set of staggered exhaust valve timing profiles.
Figure 6B:
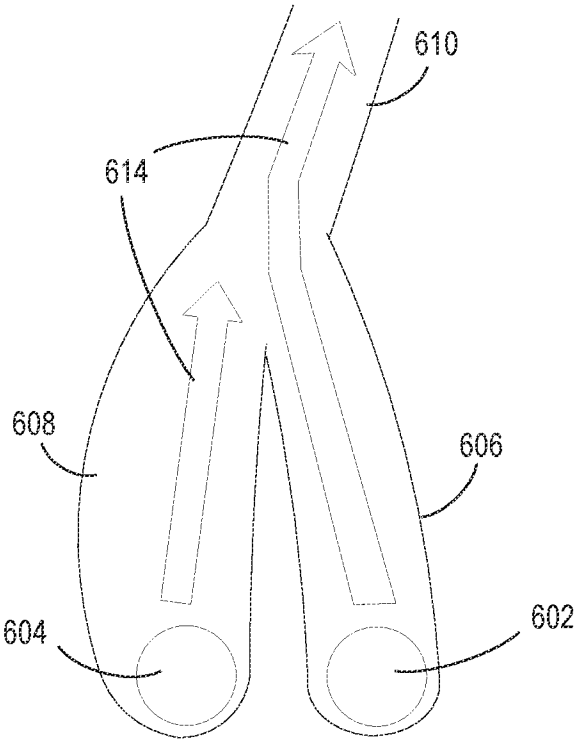
FIG. 6B shows exhaust flow through the exhaust ports corresponding to a second step of the second graph of FIG. 5.
Figure 6A:
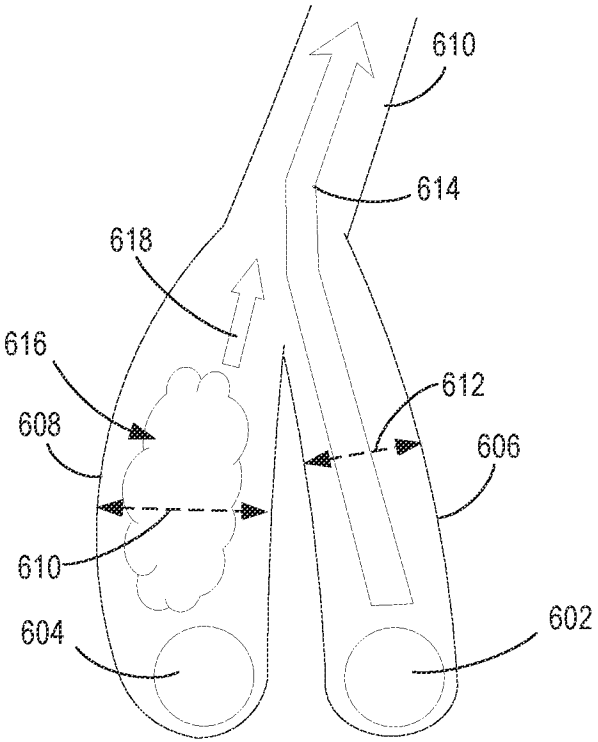
FIG. 6A shows exhaust flow through exhaust ports of a section of an exhaust manifold corresponding to a first step of the second graph of FIG. 5.
Figure 6C:
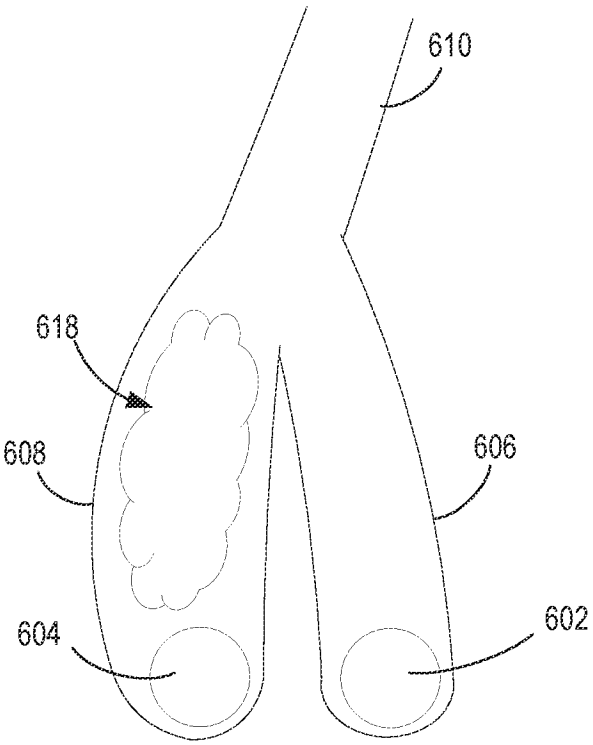
FIG. 6C shows exhaust flow through the exhaust ports corresponding to a third step of the second graph of FIG. 5.
Figure 7:
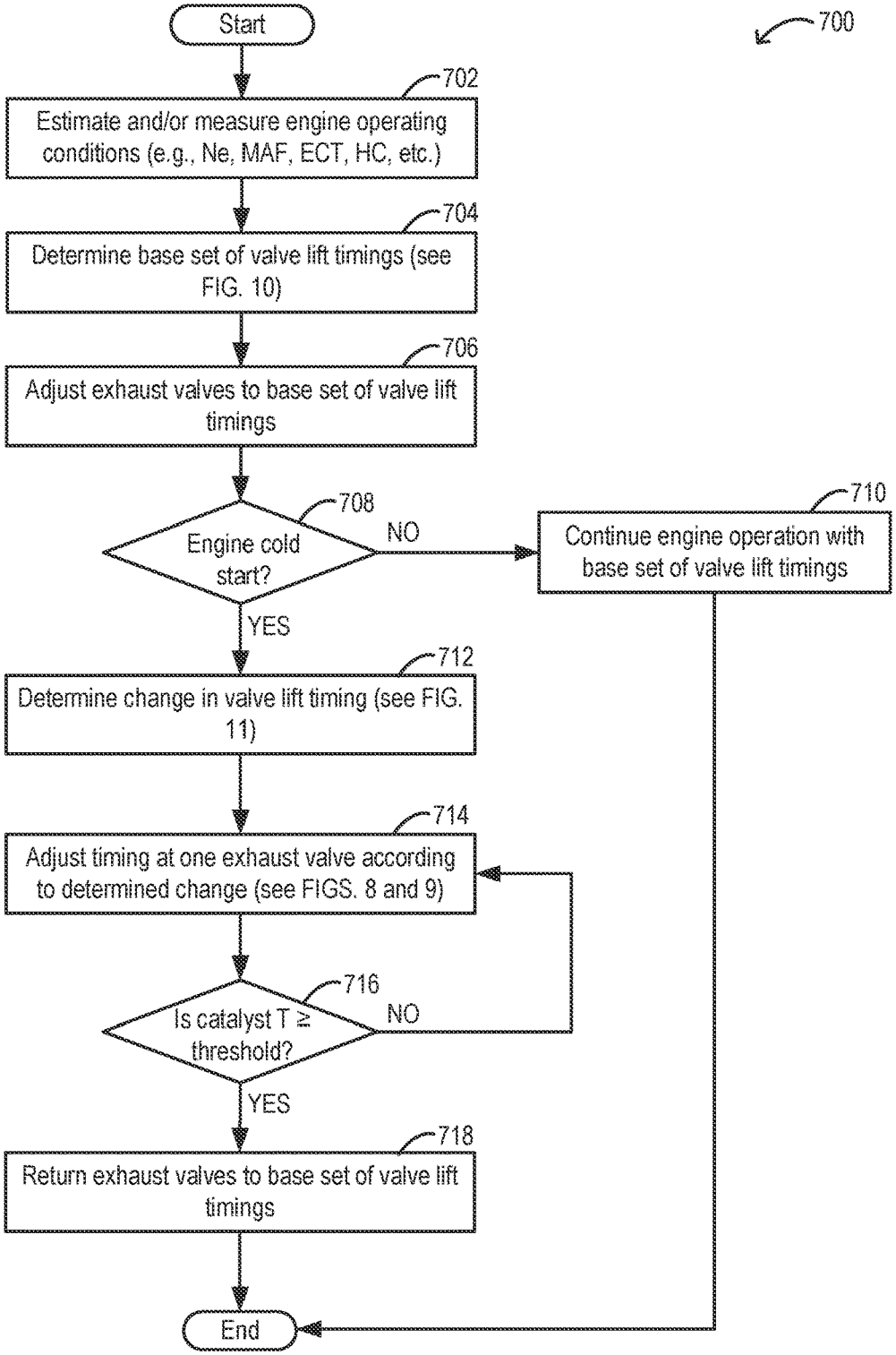
FIG. 7 shows an example of a method for decreasing HC emission during cold engine starts by implementing staggered exhaust valve timing profiles.
Figure 8:
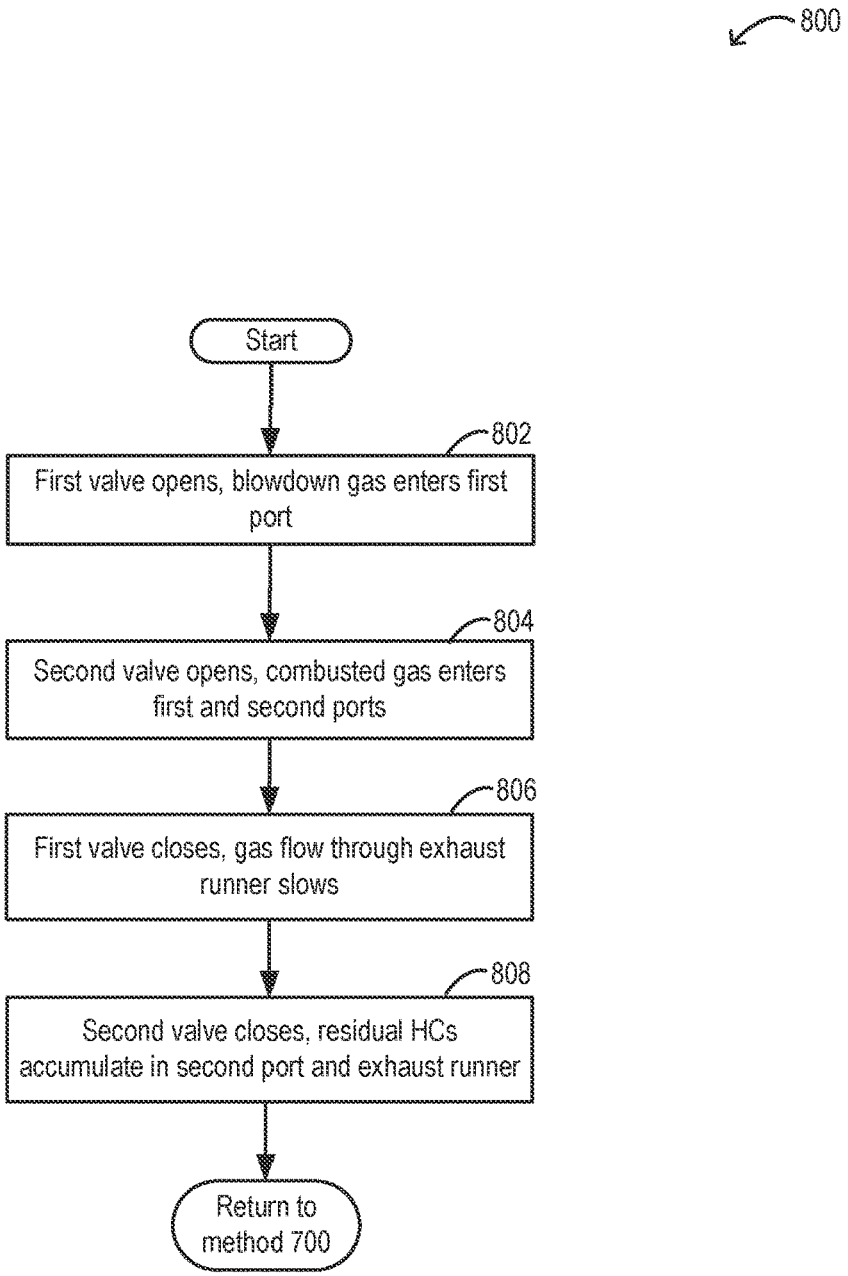
FIG. 8 shows an example of a first routine for staggering the exhaust valve timing profiles as shown in FIG. 3 which may be used in the method of FIG. 7.
Figure 9:
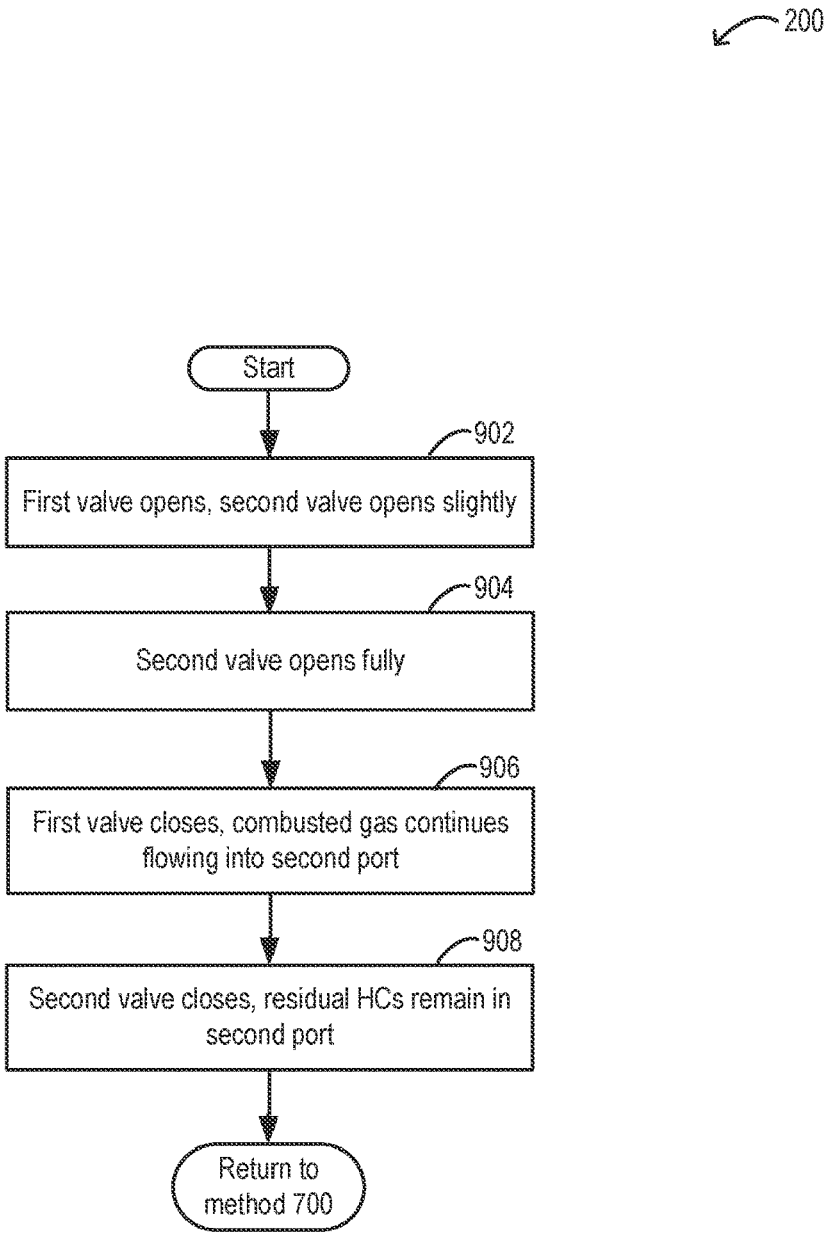
FIG. 9 shows an example of a second routine for staggering the exhaust valve timing profiles as shown in FIG. 5 which may be used in the method of FIG. 7.

The following description relates to systems and methods for staggered exhaust valve timing for reducing hydrocarbon (HC) emissions. An example vehicle engine is shown in FIG. 1, including an exhaust system through which HCs and other combustion byproducts may be treated before exhaust gas is released to the atmosphere. Each cylinder of the engine may be configured with more than one exhaust valve coupled to an exhaust manifold as shown in FIG. 2. Staggered valve timing may be implemented at the exhaust valves of each cylinder, thus allowing increased mixing of hot, combusted gases with residual gases in exhaust ports of the exhaust manifold to enhance port oxidation. An example of a first set of timing profiles for a first exhaust manifold configuration providing staggered exhaust valve opening is shown in FIG. 3 and a corresponding flow of exhaust gases through exhaust ports into an exhaust runner is depicted in FIGS. 4A-4C. An example of a second set of timing profiles is shown in FIG. 5 for a second exhaust manifold configuration. Exhaust gas flow through the second exhaust manifold configuration is illustrated in FIGS. 6A-6C. An example of a method for increasing port oxidation through staggered exhaust valve timing is shown in FIG. 7 and exemplary routines for the first set of timing profiles and the second set of timing profiles are depicted in FIGS. 8 and 9, respectively. The methods may include reference to relationships between engine speed, load, and exhaust valve timing, examples of which are plotted in graphs shown in FIGS. 10 and 11.

Turning now to FIG. 1, an example of a cylinder 14 of an internal combustion engine 10 is illustrated, which may be included in a vehicle 5. Engine 10 may be controlled at least partially by a control system, including a controller 12, and by input from a vehicle operator 130 via an input device 132. In this example, input device 132 includes an accelerator pedal and a pedal position sensor 134 for generating a proportional pedal position signal PP. Cylinder (herein, also "combustion chamber") 14 of engine 10 may include combustion chamber walls 136 with a piston 138 positioned therein. Piston 138 may be coupled to a crankshaft 140 so that reciprocating motion of the piston is translated into rotational motion of the crankshaft. Crankshaft 140 may be coupled to at least one drive wheel 55 of the passenger vehicle via a transmission 54, as described further below. Further, a starter motor (not shown) may be coupled to crankshaft 140 via a flywheel to enable a starting operation of engine 10.

In some examples, vehicle 5 may be a hybrid vehicle with multiple sources of torque available to one or more vehicle wheels 55. In other examples, vehicle 5 is a conventional vehicle with only an engine. In the example shown, vehicle 5 includes engine 10 and an electric machine 52. Electric machine 52 may be a motor or a motor/generator. Crankshaft 140 of engine 10 and electric machine 52 are connected via transmission 54 to vehicle wheels 55 when one or more clutches 56 are engaged. In the depicted example, a first clutch 56 is provided between crankshaft 140 and electric machine 52, and a second clutch 56 is provided between electric machine 52 and transmission 54. Controller 12 may send a signal to an actuator of each clutch 56 to engage or disengage the clutch, so as to connect or disconnect crankshaft 140 from electric machine 52 and the components connected thereto, and/or connect or disconnect electric machine 52 from transmission 54 and the components connected thereto. Transmission 54 may be a gearbox, a planetary gear system, or another type of transmission. The powertrain may be configured in various manners including as a parallel, a series, or a series-parallel hybrid vehicle.

Electric machine 52 receives electrical power from a traction battery 58 to provide torque to vehicle wheels 55. Electric machine 52 may also be operated as a generator to provide electrical power to charge battery 58, for example, during a braking operation.

Cylinder 14 of engine 10 can receive intake air via an air induction system (AIS) including a series of intake passages 142, 144, and intake manifold 146. Intake manifold 146 can communicate with other cylinders of engine 10 in addition to cylinder 14, as shown in FIG. 2. In some examples, one or more of the intake passages may include a boosting device, such as a turbocharger or a supercharger. For example, FIG. 1 shows engine 10 configured with a turbocharger 175, including a compressor 174 arranged between intake passages 142 and 144 and an exhaust turbine 176 arranged along an exhaust manifold 148. Compressor 174 may be at least partially powered by exhaust turbine 176 via a shaft 180 when the boosting device is configured as a turbocharger. However, in other examples, such as when engine 10 is provided with a supercharger, compressor 174 may be powered by mechanical input from a motor or the engine and exhaust turbine 176 may be optionally omitted.

A throttle 162 including a throttle plate 164 may be provided in the engine intake passages for varying the flow rate and/or pressure of intake air provided to the engine cylinders. For example, throttle 162 may be positioned downstream of compressor 174, as shown in FIG. 1, or may be alternatively provided upstream of compressor 174.

Exhaust manifold 148 can receive exhaust gases from other cylinders of engine 10 in addition to cylinder 14. An exhaust gas sensor 128 is shown coupled to exhaust manifold 148 upstream of an emission control device 178. Exhaust gas sensor 128 may be selected from among various suitable sensors for providing an indication of exhaust gas air/fuel ratio (AFR), such as a linear oxygen sensor or UEGO (universal or wide-range exhaust gas oxygen), a two-state oxygen sensor or EGO (as depicted), a HEGO (heated EGO), a NOx, a HC, or a CO sensor, for example. Emission control device 178 may be a three-way catalyst, a NOx trap, various other emission control devices, or combinations thereof.

Each cylinder of engine 10 may include one or more intake valves and one or more exhaust valves. For example, cylinder 14 is shown including at least one intake poppet valve 150 and at least one exhaust poppet valve 156 located at an upper region of cylinder 14. In some examples, each cylinder of engine 10, including cylinder 14, may include at least two intake poppet valves and at least two exhaust poppet valves located at an upper region of the cylinder, as shown in FIG. 2 and described further below. Intake poppet valve 150 may be controlled by controller 12 via an actuator 152. Similarly, exhaust poppet valve 156 may be controlled by controller 12 via an actuator 154. The positions of intake poppet valve 150 and exhaust poppet valve 156 may be determined by respective valve position sensors (not shown).

During some conditions, controller 12 may vary the signals provided to actuators 152 and 154 to control the opening and closing of the respective intake and exhaust valves. The valve actuators may be of an electric valve actuation type, a cam actuation type, or a combination thereof. The intake and exhaust valve timing may be controlled concurrently, or any of a possibility of variable intake cam timing, variable exhaust cam timing, dual independent variable cam timing, or fixed cam timing may be used. Each cam actuation system may include one or more cams and may utilize one or more of cam profile switching (CPS), variable cam timing (VCT), variable valve timing (VVT), and/or variable valve lift (VVL) systems that may be operated by controller 12 to vary valve operation. For example, cylinder 14 may alternatively include an intake valve controlled via electric valve actuation and an exhaust valve controlled via cam actuation, including CPS and/or VCT. In other examples, the intake and exhaust valves may be controlled by a common valve actuator (or actuation system) or a variable valve timing actuator (or actuation system).

Cylinder 14 can have a compression ratio, which is a ratio of volumes when piston 138 is at bottom dead center (BDC) to top dead center (TDC). In one example, the compression ratio is in the range of 9:1 to 10:1. However, in some examples where different fuels are used, the compression ratio may be increased. This may happen, for example, when higher octane fuels or fuels with higher latent enthalpy of vaporization are used. The compression ratio may also be increased if direct injection is used due to its effect on engine knock.

In some examples, each cylinder of engine 10 may include a spark plug 192 for initiating combustion. An ignition system 190 can provide an ignition spark to combustion chamber 14 via spark plug 192 in response to a spark advance signal SA from controller 12, under select operating modes. A timing of signal SA may be adjusted based on engine operating conditions and driver torque demand. For example, spark may be provided at maximum brake torque (MBT) timing to maximize engine power and efficiency. Controller 12 may input engine operating conditions, including engine speed, engine load, and exhaust gas AFR, into a look-up table and output the corresponding MBT timing for the input engine operating conditions. In other examples the engine may ignite the charge by compression as in a diesel engine.

In some examples, each cylinder of engine 10 may be configured with one or more fuel injectors for providing fuel thereto. As a non-limiting example, cylinder 14 is shown including a fuel injector 166. Fuel injector 166 may be configured to deliver fuel received from a fuel system 8. Fuel system 8 may include one or more fuel tanks, fuel pumps, and fuel rails. Fuel injector 166 is shown coupled directly to cylinder 14 for injecting fuel directly therein in proportion to the pulse width of a signal FPW-1 received from controller 12 via an electronic driver 168. In this manner, fuel injector 166 provides what is known as direct injection (hereafter also referred to as "DI") of fuel into cylinder 14. While FIG. 1 shows fuel injector 166 positioned to one side of cylinder 14, fuel injector 166 may alternatively be located overhead of the piston, such as near the position of spark plug 192. Such a position may increase mixing and combustion when operating the engine with an alcohol-based fuel due to the lower volatility of some alcohol-based fuels. Alternatively, the injector may be located overhead and near the intake valve to increase mixing. Fuel may be delivered to fuel injector 166 from a fuel tank of fuel system 8 via a high pressure fuel pump and a fuel rail. Further, the fuel tank may have a pressure transducer providing a signal to controller 12.

Fuel injector 170 is shown arranged in intake manifold 146, rather than in cylinder 14, in a configuration that provides what is known as port fuel injection (hereafter referred to as "PFI") into the intake port upstream of cylinder 14. Fuel injector 170 may inject fuel, received from fuel system 8, in proportion to the pulse width of signal FPW-2 received from controller 12 via electronic driver 171. Note that a single driver 168 or 171 may be used for both fuel injection systems, or multiple drivers, for example driver 168 for fuel injector 166 and driver 171 for fuel injector 170, may be used, as depicted.

In an alternate example, each of fuel injectors 166 and 170 may be configured as direct fuel injectors for injecting fuel directly into cylinder 14. In still another example, each of fuel injectors 166 and 170 may be configured as port fuel injectors for injecting fuel upstream of intake poppet valve 150. In yet other examples, cylinder 14 may include only a single fuel injector that is configured to receive different fuels from the fuel systems in varying relative amounts as a fuel mixture, and is further configured to inject this fuel mixture either directly into the cylinder as a direct fuel injector or upstream of the intake valves as a port fuel injector.

Fuel may be delivered by both injectors to the cylinder during a single cycle of the cylinder. For example, each injector may deliver a portion of a total fuel injection that is combusted in cylinder 14. Further, the distribution and/or relative amount of fuel delivered from each injector may vary with operating conditions, such as engine load, knock, and exhaust temperature, such as described herein below. Fuel injectors 166 and 170 may have different characteristics. These include differences in size, for example, one injector may have a larger injection hole than the other. Other differences include, but are not limited to, different spray angles, different operating temperatures, different targeting, different injection timing, different spray characteristics, different locations etc. Moreover, depending on the distribution ratio of injected fuel among injectors 170 and 166, different effects may be achieved.

Controller 12 is shown in FIG. 1 as a microcomputer, including a microprocessor unit 106, input/output ports 108, an electronic storage medium for executable programs (e.g., executable instructions) and calibration values shown as non-transitory read-only memory chip 110 in this particular example, random access memory 112, keep alive memory 114, and a data bus. Controller 12 may receive various signals from sensors coupled to engine 10, including signals previously discussed and additionally including a measurement of inducted mass air flow (MAF) from a mass air flow sensor 122; an engine coolant temperature (ECT) from a temperature sensor 116 coupled to a cooling sleeve 118; an exhaust gas temperature from a temperature sensor 158 coupled to exhaust manifold 148; a profile ignition pickup signal (PIP) from a Hall effect sensor 120 (or other type) coupled to crankshaft 140; throttle position (TP) from a throttle position sensor; signal EGO from exhaust gas sensor 128, which may be used by controller 12 to determine the AFR of the exhaust gas; and an absolute manifold pressure signal (MAP) from a MAP sensor 124. An engine speed signal, RPM, may be generated by controller 12 from signal PIP. The manifold pressure signal MAP from MAP sensor 124 may be used to provide an indication of vacuum or pressure in the intake manifold 146. Controller 12 may infer an engine temperature based on the engine coolant temperature and infer a temperature of catalyst 178 based on the signal received from temperature sensor 158. Additional sensors providing data to controller 12 are shown in FIG. 2 and described further below.

Controller 12 receives signals from the various sensors of FIGS. 1 and 2 and employs various actuators of FIGS. 1 and 2 to adjust engine operation based on the received signals and instructions stored on a memory of the controller. For example, upon receiving a signal from the MAP sensor 124, controller 12 may command adjustment of fuel injection as provided by fuel injector 166 or 170 based on the engine temperature detected by the temperature sensor 116 or based on an air-to-fuel ratio inferred based on the signal EGO from the exhaust gas sensor 128.

As described above, FIG. 1 shows only one cylinder of a multi-cylinder engine. As such, each cylinder may similarly include its own set of intake/exhaust valves, fuel injector(s), spark plug, etc. It will be appreciated that engine 10 may include any suitable number of cylinders, including 2, 3, 4, 5, 6, 8, 10, 12, or more cylinders. Further, each of these cylinders can include some or all of the various components described and depicted by FIG. 1 with reference to cylinder 14. A view of engine 10 with multiple cylinders, each cylinder including more than one exhaust valve coupled to the exhaust manifold 148, is shown in FIG. 2.

FIG. 2 shows an example embodiment of an engine system 200, which includes engine 10 of FIG. 1, a control system 202 that includes controller 12 of FIG. 1, and other components depicted in FIG. 1 which are similarly numbered and will not be re-introduced. The control system 202 further includes sensors 204 and actuators 206 as described above with reference to FIG. 1. An engine block 208 is shown in engine system 200 with a plurality of cylinders 14 with intake manifold 146 configured to supply intake air and/or fuel to the cylinders 14 and exhaust manifold 148 configured to exhaust combustion products from the cylinders 14. Ambient air flow can enter the intake system through intake passage 142 and 144.

Cylinders 14 may each be serviced by one or more valves. As shown in FIG. 2, cylinders 14 each include intake valves 12 and 14, which may each be the intake poppet valve 150 of FIG. 1, and exhaust valves E1 and E3, which may each be the exhaust poppet valve 156 of FIG. 1. The intake valves may be actuatable between an open position allowing intake air into the cylinders 14 and a closed position blocking intake air from the cylinders by methods described above with reference to FIG. 1. Likewise, the exhaust valves may be actuatable between an open position allowing exhaust gas out of the cylinders 14 and a closed position blocking gases from being released from the cylinders, as described above with reference to FIG. 1.

The exhaust manifold 148 may include exhaust ports coupled to each of the engine cylinders 14. In some examples (not shown in FIG. 2), the exhaust manifold 148 may also include an exhaust wastegate to allow at least a portion of the exhaust gas flow to bypass the turbine 176. A section of the exhaust manifold 148, as indicated by dashed area 210, is described hereafter and the description of the section shown in dashed area 210 may be applicable to each section of the exhaust manifold 148 coupled to each cylinder 14 of the engine 10.

As shown in dashed area 210, the exhaust valve E1 is coupled to a first exhaust port 214 and the exhaust valve E2 is coupled to a second exhaust port 216. The first exhaust port 214 merges with the second exhaust port 216 at a merging point 218 to form an exhaust runner 212. The exhaust runner 212 merges with a common exhaust passage 220 of the exhaust manifold 148 which is similarly coupled to other exhaust runners of the exhaust manifold. As appreciated by FIG. 2, each cylinder of engine 10 includes two exhaust ports that merge into an exhaust runner.

After a combustion cycle, residual exhaust gasses in the exhaust ports may include unreacted HCs. For example, during a drive cycle, combusted exhaust gas flowing through the exhaust system may be hot, enabling at least partial oxidation of HCs in the exhaust ports before the exhaust gases are further treated at the emission control device and then released to the atmosphere. However, when the engine is turned off for a period of time, the engine, including components of the exhaust system, may cool. Subsequent engine startup at low temperature, e.g., a cold start, may result in accumulation of HC residuals in the exhaust ports during initial combustion cycles. For example, a large amount of HCs may be slowly pushed into the exhaust ports from wetting of piston top surfaces prior to closing of the exhaust valves. In addition, a combustion AFR may be enriched at cold startup to compensate for low fuel vaporization, further contributing to HC residuals in the exhaust ports. The low temperature of the exhaust gas and low oxygen levels, due to enriched combustion, may lead to undesirably high HC emissions when the exhaust gas is pushed out of the exhaust manifold without mixing with high temperature exhaust gas.

For cylinders with multiple exhaust valves, HC emissions may be reduced by staggering operation of the exhaust valves to regulate exhaust gas flow through the exhaust ports. A staggered exhaust valve timing profile may allow more control over the exhaust gas flow rate, enabling location-specific variations in flow. This may increase mixing of incoming high temperature exhaust flow with the residual HC buildup in the exhaust ports as well as increasing oxygen supply, as delivered during cylinder blowdown, to enhance HC oxidation.

Cylinder blowdown occurs when at least one exhaust valve of a cylinder is opened before the cylinder piston reaches BDC. Thus, the exhaust valve is open during a portion of a power stroke of the cylinder, thereby expelling exhaust gases (e.g., a hot mixture of combusted air and fuel) from the cylinder prior to TDC. During an exhaust stroke, subsequent to the power stroke, the piston transitions from BDC to TDC, pushing remaining exhaust gases out of the cylinder and into the exhaust manifold. All exhaust valves of the cylinder may be open during the exhaust stroke to expedite exhaust gas removal. The exhaust valves may be opened to respective maximum amounts of lift during this stroke, thus enabling a maximum flow rate of exhaust gases through the exhaust valves and into the exhaust ports.

Two exemplary sets of exhaust valve timing profiles may be used to stagger exhaust valve opening at a cylinder when engine temperature is low. A first set of profiles, as shown in FIGS. 3-4C, includes using a common opening profile that is timed differently for each exhaust valve. A second set of profiles, as shown in FIGS. 5-6C, includes using different profiles for each exhaust valve. Both sets of profiles may rely on opening of a first exhaust valve during cylinder blowdown to facilitate initial mixing of HC residuals with hot combusted gases at high oxygen levels. A second exhaust valve may be opened while the first exhaust valve is open during an exhaust stroke of the cylinder to further enhance HC oxidation. Late in the exhaust stroke, the first exhaust valve may be closed, which slows a flow of exhaust gases into an exhaust runner coupled to the first exhaust valve and promotes storage of residual exhaust gas, with high HC levels, at an exhaust port coupled to the second exhaust valve. At a subsequent exhaust stroke, mixing of the residual exhaust gas with incoming, hot exhaust gas is repeated. In this way, HC emissions during cold engine starts are reduced.

FIG. 3 shows a graph 300 depicting a first set of exhaust valve timing profiles for a cylinder with two exhaust valves. For example, the cylinder may be one of the cylinders 14 depicted in FIG. 2. The x-axis of the graph represents crankshaft angle and the y-axis of the graph represents exhaust valve lift. A first plot 301 depicts a profile for a first exhaust valve and a second plot 303 depicts a profile for a second exhaust valve. The profiles of the exhaust valves may be similar, e.g., rates of opening, closing, maximum amount of lift, and overall duration of valve operation, but offset by a predetermined amount of crankshaft rotation. For example, the profile of the first exhaust valve may be offset from the profile of the second exhaust valve by 45 degrees of crank angle (CA). As another example, the profile of the exhaust valve may be offset from the profile of the second exhaust valve by 20 degrees, or 60 degrees. In other examples, the offset may be any angle between 20 and 60 degrees. In some examples, the first and second exhaust valves may have different profiles where the first exhaust valve may open 20 to 50 degrees of CA earlier than shown in FIG. 3 and the second exhaust valve may close 20 to 50 degrees of CA later than shown in FIG. 3.

As shown in FIGS. 4A-4C, the first exhaust valve 402 may be a right exhaust valve 402 and the second exhaust valve 404 may be a left exhaust valve 404. A section of the exhaust manifold 148 of FIG. 2 is depicted in FIGS. 4A-4C, e.g., the section indicated by dashed area 210. The first exhaust valve 402 may be coupled to the first exhaust port 214 of FIG. 2 and the second exhaust valve 404 may be coupled to the second exhaust port 216 of FIG. 2 and exhaust gases flow from the first and second exhaust ports 214, 216 into the exhaust runner 212. The exhaust valve timing profiles, as illustrated in graph 300 of FIG. 3, are staggered to reduce HC emissions during engine cold starts by increasing oxidation within the exhaust ports and exhaust runner. Graph 300 is divided into a first step 302, a second step 304, and a third step 306 during an exhaust stroke of the cylinder. Flow of exhausts gases through the section of the exhaust manifold are depicted in FIGS. 4A-4C, corresponding to the first step 302, the second step 304, and the third step 306, respectively.

During the first step 302 of graph 300, the first exhaust valve is opened, e.g., the first exhaust valve is lifted and an opening of the exhaust valve is increased, before the cylinder piston is at BDC, while the second exhaust valve remains closed. For example, as shown in FIG. 4A, opening the first exhaust valve 402 allows blowdown gases, e.g., hot combusted gases with low HC and high oxygen levels, to flow through the first exhaust port 214, as indicated by arrow 406. The blowdown flow may be rapid, allowing the hot gases to impinge upon residual HCs 408 stored in the second exhaust port 216 and the exhaust runner 212 (e.g., from a previous combustion cycle) and generate turbulence therein. The blowdown gases mix with the residual HCs, increasing temperature and oxygen levels to drive HC oxidation in the second exhaust port 216 and the exhaust runner 212.

Returning to FIG. 3, the second step 304 of graph 300 begins after BDC of the cylinder with increasing an opening of the second exhaust valve while continuing to increase the opening of the first exhaust valve. The openings of the exhaust valves are increased at a similar rate, as described above and the opening of the first exhaust valve is greater than the opening of the second exhaust valve until the first exhaust valve reaches a maximum opening or amount of lift. The maximum opening of the first exhaust valve may occur after BDC by, for example, 45 degrees, or an angle between 20 and 60 degrees. After the first exhaust valve reaches maximum lift, the opening of the first exhaust valve may be less than the opening of the second exhaust valve during the remainder of the second step 304 of FIG. 3.

The opening/lift of the first exhaust valve is decreased after reaching the maximum lift. As the opening of the first exhaust valve is reduced, the second exhaust valve reaches a maximum opening or amount of lift. The maximum lift of the second exhaust valve may occur at a delay of 30 degrees, 45 degrees, or an angle between 30 and 60 degrees after the maximum lift of the first exhaust valve. After reaching maximum lift, the opening of the second exhaust valve is decreased at a similar rate as the first exhaust valve.

The exhaust valves each reach maximum amounts of opening or lift during the second step 304, allowing a maximum flow of exhaust gases into each of the exhaust ports. Both exhaust valves are open throughout the duration of the second step 304 until the first exhaust valve is closed at the end of the second step 304. For example, as shown in FIG. 4B, the second exhaust valve 404 is open, allowing hot combusted gases with intermediate oxygen levels to flow through both the first exhaust port 214 and the second exhaust port 216 and into the exhaust runner 212, as indicated by arrows 410. Flow rates of the gases into the exhaust ports are high, particularly when the exhaust valves reach their respective maximum lifts. As a result, further HC oxidation occurs in the exhaust ports and runner. As the mixture proceeds to flow down the exhaust runner 212, the residual HC is oxidized by the high temperature blowdown gas at a rate such that when the mixed gas flow reaches an exhaust turbine, e.g., exhaust turbine 176 of FIG. 1, the HC content of the gas is reduced.

During the third step 306 of graph 300, the opening of the second exhaust valve continues to decrease until the end of the exhaust stroke (e.g., until TDC) at which the second exhaust valve is closed. The closing of the second exhaust valve is delayed from the closing of the first valve by a similar amount as the difference between the exhaust valves reaching their respective maximum lifts. For example, as shown in FIG. 4C, exhaust gas flow into the second exhaust port 216 from the second exhaust valve 404 is relatively slow during the third step 306 (e.g., slower than during the second step 304) as the cylinder piston approaches TDC. The flow rate into the second exhaust port 216 slows as the opening of the second exhaust valve 404 decreases. Evaporation of HCs from wetted piston surfaces, the wetting occurring due to formation of liquid fuel films on piston surfaces during late fuel injection, may cause the HCs 408 to accumulate in the second exhaust port 216 and the exhaust runner 212, residing therein until a subsequent exhaust stroke.

The first set of profiles, as shown in FIG. 3, may be implemented as each cylinder of the engine. However, mixing of residual HCs with exhaust gases may be greater at cylinders where the exhaust ports have different inner volumes. For example, the exhaust ports coupled to an outboard cylinder, e.g., a cylinder at an end of a cylinder bank, may have different lengths due to a curvature of the exhaust ports as the exhaust ports extend a distance between the cylinder and the exhaust runner. At the outboard cylinder, an outboard exhaust port may be longer, with a larger inner volume, than an inboard, shorter exhaust port. At the region where the exhaust ports merge into the exhaust runner, e.g., the merging region 218 of FIG. 2, a flow rate in the inboard exhaust port may be faster than in the outboard exhaust port. Thus, the first exhaust valve, e.g., the exhaust valve that is opened first during the exhaust stroke, may be coupled to the shorter, inboard exhaust port to enhance impingement of the exhaust gases on the residual HCs. The second exhaust valve may be coupled to the longer, outboard exhaust port where the residual HCs are stored until a subsequent exhaust stroke of the cylinder.

Additionally, a duration of each of the steps shown in graph 300 in FIGS. 3 (and 500 in FIG. 5, described further below) may vary depending on engine operating conditions. As a non-limiting example, the first step may be ¼ of the exhaust stroke, the second step may be ½ of the exhaust stroke and the third step may be ¼ of the exhaust stroke. However, the relative durations of each step may increase or decreased based on engine speed. For example, the duration of the first step, during which only one valve is open, may be increased when ambient temperatures are low to increase mixing of residual HCs with hot combusted gases. In other words, the opening of the second exhaust valve relative to the opening of the first exhaust valve may be delayed by a greater amount during lower ambient temperature conditions than during higher ambient temperature conditions.

FIG. 5 shows a graph 500 depicting a second set of exhaust valve timing profiles for a cylinder with two exhaust valves, such as one of the cylinders 14 of FIG. 2. The x-axis of the graph represents crankshaft angle and the y-axis of the graph represents exhaust valve lift. A first plot 501 depicts a profile for a first exhaust valve and a second plot 503 depicts a profile for a second exhaust valve. The exhaust valves may be coupled to exhaust ports with different volumes.

For example, an alternate embodiment of a section of an exhaust manifold is shown in FIGS. 6A-6C. Therein, the first exhaust valve may be a right exhaust valve 602 coupled to a first exhaust port 606 and the second exhaust valve may be a left exhaust valve 604 coupled to a second exhaust port 608. The first and second exhaust ports 606, 608 may merge at an exhaust runner 610. The second exhaust port 608 may have a larger diameter 612 than a diameter 614 of the first exhaust port 606, as shown in FIG. 6A, such that an inner volume of the second exhaust port 608 is greater than an inner volume of the first exhaust port 606. The different diameters and volumes of the exhaust ports allows residual HCs to be stored exclusively in the second exhaust port 608. In this way, the first exhaust port 606 is only exposed to combusted gases with low HC concentration.

The exhaust valve timing profiles, as illustrated in graph 500 of FIG. 5, are also staggered to reduce HC emission during engine cold starts and may be divided into a first step 502, a second step 504 and a third step 506 during an exhaust stroke of the cylinder. However, whereas the first set of exhaust valve timing profiles relies on impingement of the exhaust gases on the residual HCs to generate fast, turbulent mixing, the second set of exhaust valve timing profiles instead facilitates slower, more gradual mixing of the exhaust gases with the HCs. Flow of exhaust gases through the section of the exhaust manifold are depicted in FIGS. 6A-6C, corresponding to the first step 502, the second step 504, and the third step 506, respectively.

During the first step 502 of graph 500, the first exhaust valve 602 is opened before the cylinder piston is at BDC. For example, as shown in FIG. 6A, opening the first exhaust valve 602 allows blowdown gases, e.g., hot combusted gases with low HC and high oxygen levels, to flow through the first exhaust port 606, and the exhaust runner 610, as indicated by arrow 614. Residual HCs 618 are stored in the second exhaust port 608 from a previous combustion cycle. The second exhaust valve 604 is opened slightly, e.g., to a lesser extent than the first exhaust valve 602 during the first step 502 to push the residual HCs 618 towards the exhaust runner 610, as indicated by arrow 618. In other words, a distance that the second exhaust valve is lifted is less than a distance that the first exhaust valve is lifted, as depicted in FIG. 5. In one example, the second exhaust valve is lifted one-fifth of the distance that the first exhaust valve is lifted. In another example, the second exhaust valve is lifted one-tenth of the distance that the first exhaust valve is lifted. In yet other examples, the second exhaust valve is lifted anywhere between one-tenth to one-fifth the distance that the first exhaust valve is lifted.

As such, over a same range of crankshaft angles, e.g., between when the first exhaust valve is initially lifted and BDC, the first exhaust valve is lifted at a faster rate than the second exhaust valve. For example, the first exhaust valve may be lifted at a rate that is faster than the lifting of the second exhaust valve corresponding to relative distances of lift of each exhaust valve at BDC. As an example, the first exhaust valve is lifted at a rate that is five times faster than the second exhaust valve, resulting in the second exhaust valve 604 being lifted to a distance that is one-fifth of the first exhaust valve at BDC.

As shown in FIG. 6A, flow through the first exhaust port 606 is faster than flow through the second exhaust port 608, thereby promoting entrainment of the residual HCs 618 into the exhaust runner 610. As the residual HC 608 is pushed into the blowdown gas flow, the residual HCs 618 slowly mixes with the blowdown gas which increases a temperature and provides oxygen to drive HC oxidation in the exhaust runner 610.

The second step 504 of graph 500 begins at BDC of the cylinder with increasing an opening of the second exhaust valve while the first exhaust valve remains open. The second exhaust valve may be opened at a same rate as the first exhaust valve which continues to be lifted at and after BDC. The first exhaust valve reaches a maximum amount of lift during the second step 504. The second exhaust valve also reaches a maximum amount of lift during the second step 504 but at a crankshaft angle that is retarded from the maximum lift of the first exhaust valve. For example, the maximum lift of the second exhaust valve may occur 45 degrees after the maximum lift of the first exhaust valve. However, a duration of delay between maximum lift of the first exhaust valve and maximum lift of the second exhaust valve may vary based on engine operating conditions.

Both valves are open during the second step 504 until the first exhaust valve is closed at the end of the second step 504. Closing of the first exhaust valve occurs before TDC. As described above, the exhaust valves each reach respective maximum amounts of opening or lift during the second step 504, allowing a maximum flow of exhaust gases into each of the exhaust ports. For example, as shown in FIG. 6B, as the opening of the second exhaust valve 604 is increased, driving a high flow rate of hot combusted gases with intermediate oxygen levels into the second exhaust port 216 and into the exhaust runner 212, as indicated by arrows 614. As a result, further HC oxidation occurs in the exhaust ports and exhaust runner 610.

As shown in FIG. 5, after the first exhaust valve reaches maximum lift, an opening of the first exhaust valve is decreased, e.g., closing of the first exhaust valves begins. The opening of second exhaust valve is also decreased after reaching maximum lift. The openings of the exhaust valves may be decreased at a similar rate. As the end of the second step 504 of FIG. 5 approaches, the first exhaust valve 602, as shown in FIG. 6B, is closed and the opening of the second exhaust valve 604 continues to decrease. As the piston approaches TDC, evaporated, residual HCs from wetted piston surfaces are slowly pushed through the opening of the second exhaust valve 604.

During the third step 506 of graph 500, the opening of the second exhaust valve continues to decrease as the piston passes through TDC. Inertia of the residual HCs causes the HCs to continue flowing slowly into the second exhaust port until the second exhaust valve closes. For example, as shown in FIG. 6C, the residual HCs 618 may have sufficient momentum to enter the second exhaust port 608 but not enough to flow into the exhaust runner 610. The larger inner volume of the second exhaust port 608 allows the residual HCs 618 to be collected in the second exhaust port 608 and remain in the second exhaust port 608 until a subsequent exhaust stroke.

As shown in FIG. 5, the second exhaust valve closes after the first exhaust closes. The closing of the second exhaust valve may be delayed from the closing of the first exhaust valve by a similar difference as the duration of delay between the exhaust valves reaching their respective maximum lifts. However, in other examples, the amount of delay, e.g., amount of crankshaft rotation, may differ relative to the delay between the maximum lifts of each exhaust valve if a rate of closing of the second exhaust valve is different from a rate of closing of the first exhaust valve. As such, while the second exhaust valve is depicted to close immediately after TDC in FIG. 5, the second exhaust valve may close at, slightly before, or further after TDC in other examples.

The second set of exhaust valve timing profiles, as shown in FIG. 5 and illustrated in FIGS. 6A-6C, may leverage a difference in exhaust port volume to provide gradual and thorough mixing of residual HCs with combusted gases. The staggered profiles of the exhaust valves result in confinement of the stored residual HCs to the second exhaust port and not in the exhaust runner. This may circumvent flow of the untreated HCs, e.g., HCs that do not mix with combusted gas and become oxidized, through the exhaust manifold and out to the atmosphere during early combustion cycles of a cold engine start. In other words, the exhaust runner is filled with hot, oxygenated gases prior before the residual HCs enter the exhaust runner from the second exhaust port, forcing the HCs to be oxidized prior to atmospheric release.

As described for the first set of exhaust valve timing profiles, relative durations of each of the first, second, and third steps 502, 504, and 506 of graph 500 may vary depending on engine operating conditions. Implementation of the first set of exhaust valve timing profiles versus the second set of exhaust valve timing profiles may depend on a specific configuration of an exhaust manifold of a vehicle. For example, in an exhaust manifold where the exhaust ports are similar in diameter and length for each cylinder, the first set of exhaust valve timing profiles may be applied. However, when the exhaust ports of the cylinder have different diameters, the second set of exhaust timing profiles may be preferentially implemented.

A method 700 for adjusting exhaust valve timing to increase port oxidation and reduce emissions during engine operation at low temperature is shown in FIG. 7. Method 700 may be implemented in a vehicle with an engine system such as the engine system 200 of FIG. 2. As shown in FIG. 2, the engine system 200 may include cylinders coupled to an exhaust manifold of an exhaust system, the cylinders each equipped with at least two exhaust valves each, including a first exhaust valve and a second exhaust valve. The exhaust valves may be coupled to exhaust ports and exhaust runners as depicted in FIGS. 4A-4C or FIGS. 6A-6C, where method 700 may vary depending on a configuration of the exhaust ports. As such, method 700 may also include routines 800 and 900 depicted in FIGS. 8 and 9, respectively. FIGS. 8 and 9 show routines for staggering the exhaust valve timing profiles to increase mixing between residuals HCs and exhaust gases. Instructions for carrying out method 700, routine 800 and routine 900 may be executed by a controller, such as controller 12 of FIGS. 1 and 2, based on instructions stored on a memory of the controller and in conjunction with signals received from sensors of the engine system, such as the sensors described above with reference to FIGS. 1 and 2. The controller may employ engine actuators of the engine system to adjust engine operation, according to the methods described below.

At 702, method 700 includes estimating and/or measuring current engine operating conditions. For example, engine speed may be inferred based on a PIP signal from a Hall effect sensor, such as the Hall effect sensor 120 of FIG. 1, engine load estimated based on a signal from a MAF sensor, such as the MAF sensor 122 of FIG. 1, engine temperature measured by a temperature sensor, HC levels in exhaust gas detected by one or more HC sensors in the exhaust system, etc. A base set of exhaust valve timing profiles is determined at 704 based on the current conditions and may be retrieved from the controller's memory. For example, the base timing may be obtained from a look-up table providing relationships between engine speed, load, and exhaust valve lift timing, as depicted graphically in an exemplary graph 1000 in FIG. 10. In one example, the base timing may include the exhaust valves having a common timing profile.

Graph 1000 shows exhaust valve opening, e.g., a crankshaft angle at which the exhaust valve is lifted, relative to engine speed and engine load. Operation of the exhaust valve opening, and of the engine, occurs within a range of engine speeds and loads as indicated by a shaded region in graph 1000. Each exhaust valve of each cylinder may be opened according to a look-up table providing the relationships shown in graph 1000. Furthermore, each exhaust valve may be closed based on a similar plot of exhaust valve closing as a function of engine speed and load.

Figure 10:
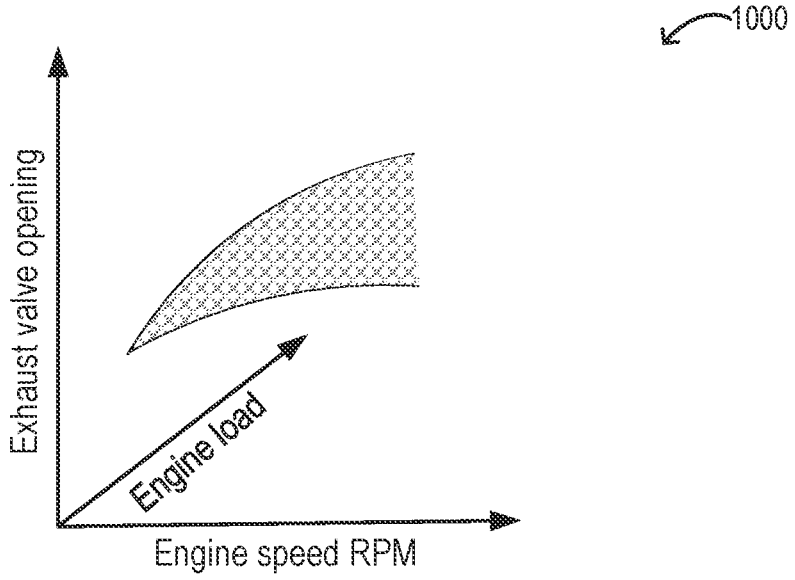
FIG. 10 shows a first graph depicting a relationship between exhaust valve timing, engine speed, and engine load.

Returning to FIG. 7, the exhaust valves are adjusted to the base set of exhaust valve timing profiles at 706. For example, the controller commands activation of exhaust valve actuators, such as the actuator 154 of FIG. 1, to lift and lower the exhaust valves according to the pre-determined timing, as indicated in FIG. 10. The method includes determining if the engine is operating under cold start conditions at 708. To detect a cold start of the engine, the controller may obtain data regarding engine temperature, exhaust gas temperature, and/or catalyst temperature (e.g., at an emission control device such as the emission control device 178 of FIG. 1). If one or more of the measured temperatures is at or above a threshold temperature indicative of warmed engine operation, the method proceeds to 710 to continue engine operation using the current, base set of exhaust valve timing profiles. The method ends.

Figure 11:
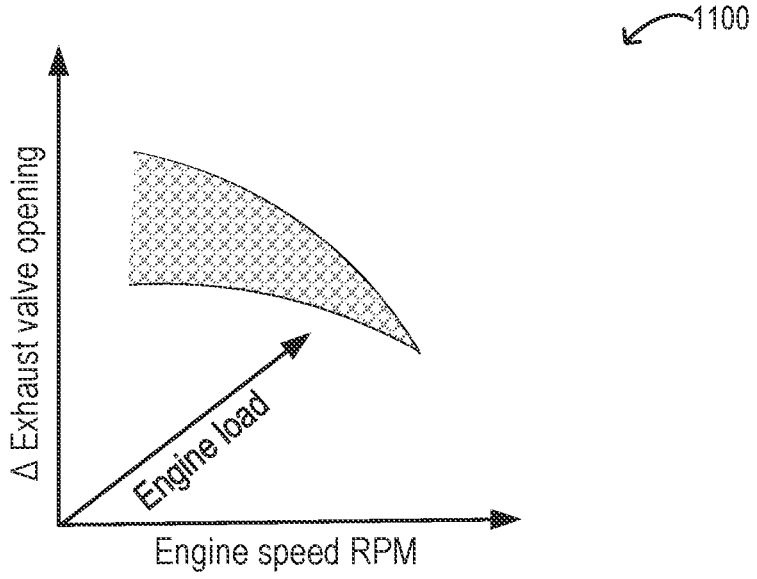
FIG. 11 shows a second graph depicting a relationship between exhaust valve timing, engine speed, and engine load.

If one or more of the measured temperatures does not reach the threshold temperature indicative of warmed engine operation, the method continues to 712 to determine a different, adjusted set of exhaust valve timing profiles. A look-up table depicting a change in relationships between engine speed, engine load, and exhaust valve timing during cold engine starts may be retrieved from the controller's memory. For example, as shown in FIG. 11, graph 1100 illustrates change in exhaust valve opening, e,g., a change in crankshaft angle as a function of engine load and engine speed. The graph 1100 may be used to modify a timing profile of the second exhaust valve while the timing profile of the first exhaust valve remains at the base timing. As an example, a value of the change in exhaust valve opening (e.g., from graph 1100), according to a specific engine speed and load, may be added to the base exhaust valve opening value corresponding to the same engine speed and load at graph 1000, resulting in an adjusted exhaust valve opening value for the second exhaust valve.

Returning to FIG. 7, at 714, method 700 includes adjusting the exhaust lift timing profile at the second valve to open at the crankshaft angle determined based on the relationship between change in exhaust valve opening, engine speed, and load, as shown in graph 1100. Upon adjustment, the opening of the second exhaust valve is delayed relative to the opening of the first exhaust valve. More specifically, the second exhaust valve may be opened at a delayed crankshaft angle relative to the first exhaust valve. In one example, the exhaust valve timings may be modified after a threshold number of initial combustion cycles have occurred, such as 5 or 6, in order to collect sufficient data regarding engine operating conditions to enable valve timing adjustment optimized for the current conditions. In another example, the exhaust valve timings may be determined according to the adjusted exhaust openings as depicted in graph 1100 of FIG. 11. In yet another example, the engine temperature may be measured upon engine startup and the adjusted timing applied to the second exhaust valve immediately upon detection of a cold engine.

Furthermore, adjusting exhaust valve timing to the second set of exhaust valve timing profiles may include determining a number of cylinders at which the modified valve timing may be implemented. For example, the number of cylinders with staggered exhaust valve opening may vary depending on an amount of HC detected in the exhaust gas. More cylinders may be adjusted to the staggered exhaust valve opening when higher HC levels are measured. In some examples, adjustment of exhaust valve timing may depend on both the HC amount and on the configuration of the exhaust ports. The exhaust ports may be arranged as shown in FIGS. 4A-4C or in FIGS. 6A-6C and routines for each arrangement are described below with reference to FIGS. 8 and 9. As an example, when the exhaust ports are shaped as shown in FIGS. 4A-4C, the outer cylinders of a cylinder bank may be adjusted to the staggered exhaust valve opening upon detection of engine cold start to utilize a difference in exhaust port length. The inner cylinders may be adjusted if HC levels are high and/or engine temperature is low, e.g., due to cold ambient temperatures.

At 716, method 700 includes determining if a catalyst of an emission control device, such as the emission control device 178 of FIG. 1, is warmed to at least a threshold temperature. The threshold temperature may be a temperature at a mid-bed of the catalyst at which a conversion efficiency of the catalyst reaches at least 95%. In one example, the threshold temperature may be 450 degrees C.

If the catalyst temperature does not reach the threshold, the method returns to 714 to continue engine operation with the adjusted and staggered exhaust valve opening. If the catalyst temperature meets the threshold, the method continues to 718 to return the exhaust valve timing to the base set of exhaust valve timing profiles, e.g., as described above with reference to FIG. 10. For example, the exhaust valve timing may be returned to the common timing profile. The timing may be adjusted at the cylinders where the staggered timing was implemented. The method ends.

Turning now to FIG. 8, it shows a first routine 800, executed as part of a single engine cylinder cycle during the engine cold start, e.g., at 714 of method 700, corresponding to graph 300 of FIG. 3 and an exhaust manifold configuration as shown in FIGS. 4A-4C. Prior to executing routine 800, unoxidized, residual HC from the previous exhaust cycle may occupy at least one of the exhaust ports coupled to the exhaust valves, as well as the exhaust runner. At 802, the routine includes opening a first exhaust valve of the exhaust valves at a first crankshaft angle before BDC to allow pneumatic communication between a first exhaust port of the exhaust ports and the cylinder. For example, when the cylinder is an outboard cylinder, the first exhaust valve may be an inboard exhaust port coupled to a shorter exhaust port than a second, longer exhaust port coupled to a second, outboard exhaust valve of the cylinder. If the cylinder is an inboard cylinder however, geometries of the first and second exhaust ports may be similar and either of the exhaust valves may be opened first.

Blowdown gas from the cylinder flows through the first exhaust port and impinges on the residual HCs, as shown in FIG. 4A. A high temperature and high oxygen concentration of the blowdown gas causes at least a portion of the residual HCs to be oxidized. At 804, the routine includes opening the second exhaust valve at a second crankshaft angle that is retarded from the first crankshaft angle, allowing combusted gas to flow through both of the exhaust ports as depicted in FIG. 4B. This corresponds with the beginning of the second step 304 of graph 300 shown in FIG. 3. The opening of the second valve allows exhaust gas, with high temperature and intermediate oxygen levels, to flow through both ports, accelerating the flow into the exhaust runner and continuing oxidation of the residual HCs. The second exhaust valve is opened at the retarded second crankshaft angle during the same combustion/cylinder cycle as the first exhaust valve is opened at the first crankshaft angle.

At 806, the routine includes closing the first exhaust valve at a third crankshaft angle and halting the exhaust gas flow into the first exhaust port, corresponding to the beginning of the third step 306 of graph 300 shown in FIG. 3. The gas flow through the exhaust runner slows and evaporated HC residuals enter the second exhaust port as depicted in FIG. 4C. At 808, the second exhaust valve closes immediately after the piston reaches TDC at a fourth crankshaft angle that is delayed from the third crankshaft angle, ending the pneumatic communication between the exhaust manifold and the cylinder. The HC residuals remain stored in the second exhaust port. The routine returns to method 700, e.g., to 716 of FIG. 7.

FIG. 9 shows a second routine 900 that may be executed as part of a single engine cylinder cycle during the engine cold start, e.g., at 714 of method 700, corresponding to graph 500 of FIG. 5 and an exhaust manifold configuration as shown in FIGS. 6A-6C. Prior to executing routine 900, unoxidized residual HCs from the previous exhaust cycle may occupy the exhaust ports and an exhaust runner. The exhaust manifold configuration as shown in FIGS. 6A-6C, where a second exhaust port, coupled to a second exhaust valve, is larger in volume than a first exhaust port, coupled to a first exhaust valve, which results in storage of the residual HCs in the second exhaust port and not in the exhaust runner or first exhaust port.

At 902, the routine includes opening a first exhaust valve at a first crankshaft angle to allow pneumatic communication between the first exhaust port and the cylinder, as depicted at the first step 502 of graph 500 of FIG. 5. The second exhaust valve is also opened but to a lesser extent than the first exhaust valve, e.g., the second exhaust valve is cracked open. Blowdown gas from the cylinder flows through the first exhaust port and into the exhaust runner, as shown in FIG. 6A. Blowdown gas also seeps into the second exhaust port and pushes the residual HCs in the second exhaust port slowly towards the exhaust runner. The faster flow of blowdown gas in the first exhaust port entrains the residual HCs into the exhaust runner and mixes thoroughly with the residual HCs, thereby oxidizing at least a portion of the HCs.

At 904, the routine includes increasing an opening of the second exhaust valve at a second crankshaft angle, retarded from the first crankshaft angle, e.g., lifting the second exhaust valve further. As shown at the second step 504 of graph 500, the increased opening of the second exhaust valve allows combusted gas to flow at a high rate through both of the exhaust ports, as illustrated in FIG. 6B. The residual HCs are pushed further into the exhaust runner and mixing/oxidation is increased. This corresponds with the beginning of the second step 504 of graph 500 shown in FIG. 5.

At 906, the routine includes closing the first exhaust valve at a third crankshaft angle before the piston reaches TDC, stopping the exhaust gas flow into the first exhaust port. This corresponds to the beginning of the third step 506 of graph 500 shown in FIG. 5. As a result, gas flow through the exhaust runner slows and evaporated HC residuals from the cylinder flow into the second exhaust port at 908, as shown in FIG. 6C. The larger volume of the second exhaust port allows all (or at least a substantial fraction, such as at least 95%) the residual HCs to remain in the second exhaust port without entering the exhaust runner.

At 908, the routine includes closing the second exhaust valve at or just after the piston reaches TDC, at a fourth crankshaft angle that is retarded relative to the third crankshaft angle. Flow of residual HCs into the second exhaust port stops. The routine returns to method 700, e.g., to 716 of FIG. 7.

In this way, HC emissions are reduced during engine cold starts. By staggering exhaust valve openings of a cylinder, where the cylinder includes at least two exhaust valves, mixing between residual HCs and hot, combusted gases is increased in exhaust ports coupled to the exhaust valves, as well as in an exhaust runner. In one example, opening one exhaust valve before another exhaust valve of the cylinder allows blowdown gases to impinge on the residual HCs, facilitating turbulent mixing of the HCs in the exhaust runner. In another example, the exhaust ports coupled to the exhaust valves of the cylinder may have different inner volumes. A geometry of the exhaust ports allows preferential storage of residual HCs from each combustion cycle in a larger exhaust port. By opening the exhaust valve coupled to the large exhaust port after opening the exhaust valve coupled to a small exhaust port, the residual HCs are thoroughly mixed with hot, oxygen-rich exhaust gas and oxidized before release to the atmosphere. Emissions of HCs are thereby controlled based by adjusting exhaust valve timing profiles.

The technical effect of staggering exhaust valve timing profiles for two exhaust valves of a cylinder during a single cylinder cycle is that oxidation of HCs is increased within an exhaust manifold of a vehicle.

The disclosure also provides support for a method for operating an engine, comprising: during a first cylinder cycle, opening a first exhaust valve of a cylinder at a first crankshaft angle, the first exhaust valve selectively allowing pneumatic communication between the cylinder and a first exhaust port, the first exhaust port merging with a second exhaust port of the cylinder before merging with other exhaust passages of the engine, and opening a second exhaust valve of the cylinder at a second crankshaft angle retarded from the first crankshaft angle, the second exhaust valve selectively allowing pneumatic communication between the cylinder and the second exhaust port. In a first example of the method, opening the second exhaust valve of the cylinder at the second crankshaft angle includes opening the second exhaust valve at a crankshaft retarded from the first crankshaft angle by between 30 to 60 degrees. In a second example of the method, optionally including the first example, the first exhaust valve opens before top dead center of a piston in the cylinder. In a third example of the method, optionally including the first and second examples, the second exhaust valve opens at or after top dead center of a piston in the cylinder. In a fourth example of the method, optionally including the first through third examples, the first exhaust valve closes at or before bottom dead center of a piston in the cylinder. In a fifth example of the method, optionally including the first through fourth examples, the second exhaust valve closes after bottom dead center of a piston in the cylinder. In a sixth example of the method, optionally including the first through fifth examples, both the first exhaust valve and the second exhaust valve remain at least partially open during an entirety of an exhaust stroke from bottom dead center to top dead center. In a seventh example of the method, optionally including the first through sixth examples, the first exhaust valve closes before the second exhaust valve. In an eighth example of the method, optionally including the first through seventh examples, the second exhaust valve is in an outboard port as compared to the first exhaust valve. In a ninth example of the method, optionally including the first through eighth examples, the second exhaust port has a larger volume than the first exhaust port. In a tenth example of the method, optionally including the first through ninth examples, the second exhaust port has a larger diameter than the first exhaust port. In an eleventh example of the method, optionally including the first through tenth examples, opening the second exhaust valve at the second crankshaft angle occurs during a cold start condition, and wherein, responsive to detection of catalyst temperature reaching a threshold, actuation of the first and second exhaust valves are adjusted to have a common opening and closing timing during a second cylinder cycle.

The disclosure also provides support for a method for an engine system of a vehicle, comprising: responsive to detection of a cold engine start during a first cylinder cycle: opening a first exhaust valve at a first crankshaft angle to allow pneumatic communication between a cylinder and a first exhaust port, opening a second exhaust valve at a second crankshaft angle, retarded from the first crankshaft angle, to allow pneumatic communication between the cylinder and a second exhaust port, the second exhaust port merging with the first exhaust port and having a larger volume than the first exhaust port, and responsive to detection of catalyst temperature reaching a threshold during a second cylinder cycle: opening the first exhaust valve and the second exhaust valve at a common crankshaft angle. In a first example of the method, the second exhaust port has one of a larger diameter or a longer length than the first exhaust port and wherein the second exhaust port is configured to receive residual exhaust gas with a high level of hydrocarbons. In a second example of the method, optionally including the first example, opening the first exhaust valve at the first crankshaft angle includes flowing blowdown gas through the first exhaust port to mix the blowdown gas with residual hydrocarbons in the second exhaust port. In a third example of the method, optionally including the first and second examples, the first exhaust valve reaches a maximum amount of lift before the second exhaust valve reaches a maximum amount of lift within an exhaust stroke of the first cylinder cycle. In a fourth example of the method, optionally including the first through third examples, the method further comprises: opening the second exhaust valve by a smaller amount of lift than an amount of lift of the first exhaust valve at the first crankshaft angle to allow the residual hydrocarbons in the second exhaust port to gradually mix with the blowdown gas. In a fifth example of the method, optionally including the first through fourth examples, further including, responsive to the detection of the cold engine start: closing the first exhaust valve at a third crankshaft angle and closing the second exhaust valve at a fourth crankshaft angle, the fourth crankshaft angle retarded from the third crankshaft angle.

The disclosure also provides support for an engine system, comprising: a cylinder with a first exhaust valve coupled to a first exhaust port and a second exhaust valve coupled to a second exhaust port, the second exhaust port having a larger volume than the second exhaust port, and a controller with computer readable instructions stored on non-transitory memory that, when executed during a cold engine start, cause the controller to: adjust a timing of the first exhaust valve to open at a first crankshaft angle, and adjust a timing of the second exhaust valve to open at a second crankshaft angle, the second crankshaft angle retarded from the first crankshaft angle. In a first example of the system, only the first exhaust valve is open during blowdown of exhaust gases in the cylinder and wherein both the first exhaust valve and the second exhaust valve are open concurrently for at least a portion of an exhaust stroke of the cylinder.

In another representation, a method for an exhaust system includes opening a first exhaust valve of a cylinder to allow blowdown gas to flow through a first exhaust port and entrain residual hydrocarbons stored in a second exhaust port into an exhaust runner of an exhaust manifold, the second exhaust port larger in diameter than the first exhaust port, and opening the second exhaust valve less than the first exhaust valve to allow blowdown gas to seep into the second exhaust port and push the residual hydrocarbons towards to the exhaust runner, wherein the entrainment of the residual hydrocarbons into the exhaust runner increases mixing of the blowdown gas with the residual hydrocarbons. In a first example of the method, an opening of the second exhaust valve is increased at a delayed crankshaft angle from the opening of the first exhaust valve. A second example of the method optionally includes the first example, and further includes, wherein the first exhaust valve is closed at an earlier crankshaft angle than the second exhaust valve and wherein the residual hydrocarbons flow slowly into the second exhaust port after the first exhaust valve is closed. The third example of the method optionally includes one or more of the first and second examples, and further includes, wherein the residual hydrocarbons are stored exclusively in the second exhaust port upon closing the second exhaust valve.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations, and/or functions may be repeatedly performed depending on the particular strategy being used. Further, the described actions, operations, and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. Moreover, unless explicitly stated to the contrary, the terms "first," "second," "third," and the like are not intended to denote any order, position, quantity, or importance, but rather are used merely as labels to distinguish one element from another. The subject matter of the present disclosure includes all novel and non-obvious combinations and sub-combinations of the various systems and configurations, and other features, functions, and/or properties disclosed herein.

As used herein, the term "approximately" is construed to mean plus or minus five percent of the range unless otherwise specified.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method for operating an engine, comprising:

during a first cylinder cycle, opening a first exhaust valve of a cylinder at a first crankshaft angle, the first exhaust valve selectively allowing pneumatic communication between the cylinder and a first exhaust port, the first exhaust port merging with a second exhaust port of the cylinder before merging with other exhaust passages of the engine; and opening a second exhaust valve of the cylinder at a second crankshaft angle retarded from the first crankshaft angle, the second exhaust valve selectively allowing pneumatic communication between the cylinder and the second exhaust port, wherein opening the second exhaust valve at the second crankshaft angle occurs during a cold start condition, and wherein, responsive to detection of catalyst temperature reaching a threshold, actuation of the first and second exhaust valves are adjusted to have a common opening and closing timing during a second cylinder cycle.

2. The method of claim 1, wherein opening the second exhaust valve of the cylinder at the second crankshaft angle includes opening the second exhaust valve at a crankshaft retarded from the first crankshaft angle by between 30 to 60 degrees.

3. The method of claim 1, wherein the first exhaust valve opens before top dead center of a piston in the cylinder.

4. The method of claim 1, wherein the second exhaust valve opens at or after top dead center of a piston in the cylinder.

5. The method of claim 1, wherein the first exhaust valve closes at or before bottom dead center of a piston in the cylinder.

6. The method of claim 1, wherein the second exhaust valve closes after bottom dead center of a piston in the cylinder.

7. The method of claim 1, wherein both the first exhaust valve and the second exhaust valve remain at least partially open during an entirety of an exhaust stroke from bottom dead center to top dead center.

8. The method of claim 1, wherein the first exhaust valve closes before the second exhaust valve.

9. The method of claim 1, wherein the second exhaust valve is in an outboard port as compared to the first exhaust valve.

10. The method of claim 1, wherein the second exhaust port has a larger volume than the first exhaust port.

11. The method of claim 1, wherein the second exhaust port has a larger diameter than the first exhaust port.

12. A method for an engine system of a vehicle, comprising:

responsive to detection of a cold engine start during a first cylinder cycle:

opening a first exhaust valve at a first crankshaft angle to allow pneumatic communication between a cylinder and a first exhaust port;

opening a second exhaust valve at a second crankshaft angle, retarded from the first crankshaft angle, to allow pneumatic communication between the cylinder and a second exhaust port, the second exhaust port merging with the first exhaust port and having a larger volume than the first exhaust port; and responsive to detection of catalyst temperature reaching a threshold during a second cylinder cycle:

opening the first exhaust valve and the second exhaust valve at a common crankshaft angle.

13. The method of claim 12, wherein the second exhaust port has one of a larger diameter or a longer length than the first exhaust port and wherein the second exhaust port is configured to receive residual exhaust gas with a high level of hydrocarbons.

14. The method of claim 12, wherein opening the first exhaust valve at the first crankshaft angle includes flowing blowdown gas through the first exhaust port to mix the blowdown gas with residual hydrocarbons in the second exhaust port.

15. The method of claim 14, wherein the first exhaust valve reaches a maximum amount of lift before the second exhaust valve reaches a maximum amount of lift within an exhaust stroke of the first cylinder cycle.

16. The method of claim 15, further comprising opening the second exhaust valve by a smaller amount of lift than an amount of lift of the first exhaust valve at the first crankshaft angle to allow the residual hydrocarbons in the second exhaust port to gradually mix with the blowdown gas.

17. The method of claim 12, further including, responsive to the detection of the cold engine start:

closing the first exhaust valve at a third crankshaft angle and closing the second exhaust valve at a fourth crankshaft angle, the fourth crankshaft angle retarded from the third crankshaft angle.

18. An engine system, comprising:

a cylinder with a first exhaust valve coupled to a first exhaust port and a second exhaust valve coupled to a second exhaust port, the second exhaust port having a larger volume than the second exhaust port; and a controller with computer readable instructions stored on non-transitory memory that, when executed during a cold engine start, cause the controller to:

during a first cylinder cycle, adjust a timing of the first exhaust valve to open at a first crankshaft angle; and adjust a timing of the second exhaust valve to open at a second crankshaft angle, the second crankshaft angle retarded from the first crankshaft angle, wherein opening the second exhaust valve at the second crankshaft angle occurs during a cold start condition, and wherein, responsive to detection of catalyst temperature reaching a threshold, actuation of the first and second exhaust valves are adjusted to have a common opening and closing timing during a second cylinder cycle.

19. The engine system of claim 17, wherein, during the first cylinder cycle, only the first exhaust valve is open during blowdown of exhaust gases in the cylinder and wherein both the first exhaust valve and the second exhaust valve are open concurrently for at least a portion of an exhaust stroke of the cylinder.

* * * * *